US005467672A

United States Patent [19]

Ashby

[11] Patent Number: 5,467,672

[45] Date of Patent: Nov. 21, 1995

[54] OPEN END RATCHET WRENCH

[76] Inventor: Earl T. Ashby, 3421 Saint Ann St., Owensboro, Ky. 42303

[21] Appl. No.: 113,710

[22] Filed: Aug. 31, 1993

Related U.S. Application Data

[63] Continuation-in-part of Ser. No. 871,119, Apr. 20, 1992, abandoned.

[51] Int. Cl.[6] ..... B25B 13/46

[52] U.S. Cl. ..... 81/58.2; 81/63.1

[58] Field of Search ..... 81/58.2, 58.4, 81/60, 63.1

[56] References Cited

U.S. PATENT DOCUMENTS

| | | | |
|---|---|---|---|
| 395,865 | 1/1889 | Abrams | 81/63.1 |
| 968,080 | 8/1910 | Repass | 81/63.1 |
| 2,660,910 | 12/1953 | Sellers | 81/58.2 |

*Primary Examiner*—D. S. Meislin
*Attorney, Agent, or Firm*—Milton M. Field

[57] ABSTRACT

An open end reversible ratchet wrench has only two pawls, only one of which is engaged with the ratchet at any one time. In a first embodiment, two multitooth pawls are pivoted on a common pivot pin. The design and spacing of the pawl teeth and the location of the pivot pin make it possible to use pawls with at least three and no more than four pawl teeth. For every rotational position of the jaw, at least one pawl tooth is engagable with the ratchet irregardless of the position of the slot. The pawls are biased towards engagement with the ratchet. A reversing switch operates a cam to select clockwise rotation of the jaw, counterclockwise rotation thereof or a neutral mode in which the jaw rotates freely without ratcheting to facilitate easy removable of the wrench. The position of the reversing switch is latched by a detent ball cooperating with locking notches on the casing. In a second embodiment, the pawls are pivoted on separate pivot pins on opposite sides of the head and extend crosswise to engage the rachet on the opposite side of the head. The selection means includes a pulley and cables to move the pawls to and from engagement with the rachet. A retention collar on the pulley has three flat surfaces which cooperate with a flat spring to retain the pulley in a selected position. In a third embodiment, a pair of pawls reciprocate along guide paths parallel to the longitudinal axis of the wrench. A single control includes a linkage for moving the pawls to and from engagement with the ratchet.

5 Claims, 10 Drawing Sheets

OPEN END RATCHET WRENCH

This is a continuation-in-part of application Ser. No. 07/871,119, filed Apr. 20, 1992, now abandoned.

BACKGROUND OF THE INVENTION

1. Field of the Invention

This invention relates to wrenches, and more particularly, to open end reversible ratchet wrenches.

2. Description of the Prior Art

Open end reversible ratchet wrenches typically include a rotatable nut-engaging operating hub or jaw which has a slot extending from its periphery to a nut-engaging opening. In order to permit rotation in one direction and block rotation in the opposite direction, a ratchet is provided on the peripheral surface of the hub. The ratchet cooperates with ratchet pawls which engage the ratchet. However, as the hub rotates, the open slot is brought into registration with the position of engagement of a pawl rendering it ineffective. For this reason, it has become the practice in the prior art to use at least two pawls for each direction of rotation.

In U.S. Pat. No. 2,712,256 to H. L. Fish for example, two pairs of pawls are used, one pair for clockwise rotation and the other pair for counterclockwise rotation of the jaw. For every position of rotation of the jaw, at least one pawl of a selected pair of pawls is engaged with the ratchet to block rotation in a nonselected direction.

Although the open end wrench shown in U.S. Pat. No. 2,851,914 to W. F. Zeckzer has only two pawls, the two pawls are needed for each direction of rotation. The pawls each have two sets of triangular teeth and are swingable to engage one set of teeth with complementary ratchet teeth. Because of this tooth design, each pawl must also engage an abutment to block rotation of the operating jaw in a nonselected direction. The pawls are controlled by a control disc at the far end of the tool handle to select either clockwise, counterclockwise, or free rotation of the jaw. A spring biased pin engages locating recesses on the control disc to lock the disc in one of its three control positions. Elongated flexible strips which are movable in guide channels couple the control disc to the pawls. The Zeckzer wrench is thus relatively complex.

The ratchet-actuated open end wrench shown in U.S. Pat. No. 2,521,419 to A. E. G. Sellers also employs two actuating members for each direction of rotation of the jaw. While the wrench of the Fish patent uses pawls having only a single tooth, hook or point for engaging the ratchet teeth, the wrench of the Sellers patent uses actuating members having five teeth with substantially the same pitch as the rectangular teeth of the ratchet. The teeth of the actuating members have a blocking side for blocking rotation toward the blocking side and a sloped side which permits the ratchet teeth to slip thereover for rotation in the direction of the sloped side. Sellers, however, requires the operation of two separate selection mechanisms to select the direction of rotation, making the tool inconvenient to use. Sellers also provides for rectilinear sliding movement of the actuating members at an angle to the axis of the tool in chambers extending outwardly from the rotating jaw members, increasing the bulk of the tool.

The use of a single dog for each direction of rotation is shown in U.S. Pat. No. 2,353,901 to L. J. Jires. Each dog has a pair of spaced teeth, at least one of which engages the ratchet for all positions of the jaw. One dog blocks rotation of the jaw in the clockwise direction, and the other dog blocks rotation in the counterclockwise direction. However, Jires requires three rows of saw-tooth shaped ratchet teeth, and the pivot for the dogs is not fixed. The overall width of the wrench is relatively large when compared with the width of the nut opening or the width of the jaw. Separate control lugs are provided for operating the dogs.

British application No. 2,197,609A of A. Manwaring teaches in FIG. 8 the use of a single pivoted pawl for engaging an open ratchet for both directions of rotation. Triangular ratchet teeth are used. FIG. 7 of this reference shows a single rectilinearly slidable pawl for rotation in only one direction. In both cases, the pawl is operable for all positions of the jaw. A similar one-way wrench is shown in British patent application No. 2,197,234A of T. V. Jackson.

SUMMARY OF THE INVENTION

It is accordingly the object of this invention to provide improved open end reversible ratchet wrenches which are simplified in structure, use reduced numbers of operating parts, are economical, and are compact. Additional objects include the provision of an improved mechanism for selecting the direction of rotation of the operating jaw and the provision of an improved mechanism for providing free rotation of the operating jaw.

To these ends, the wrench of the invention employs movable ratchet pawls with a minimum of three projecting pawl teeth to compensate for the lack of ratchet teeth in the gap formed by the slot in the operating jaw. This enables the wrench to continue ratcheting the jaw member regardless of its rotational position with only a single operating pawl engaged with the ratchet. In order to provide for sure, positive ratcheting, under relatively high torque loads, the teeth of the ratchet are rectangular—that is, the teeth each have a center line which extends radially of the jaw, have a first side facing in the clockwise direction of rotation and a second side facing in the counterclockwise direction of rotation, said sides being parallel to the center line of the tooth. The tooth also has a top side which is perpendicular to the first and second sides.

To cooperate with the rectangular ratchet teeth of the jaw, the pawl teeth are formed with a blocking side, which is designed, when engaged with the ratchet, to abut and be parallel to one of the first and second sides of one of the ratchet teeth, and a sloped side, which is designed to slip over the ratchet teeth. When the blocking side of a pawl tooth abuts the one side of a ratchet tooth, the jaw is blocked from rotation in the clockwise direction. However, the sloped side of the pawl tooth slips over the second side of the adjacent ratchet tooth, allowing rotation in the counterclockwise direction. Likewise, when the blocking side of a pawl tooth abuts the second side of a ratchet tooth, the jaw is blocked for rotation in the counterclockwise direction with rotation in the clockwise direction permitted.

In two embodiments of the invention pivoted pawls are used. With a ratchet with rectangular ratchet teeth and pivoted pawls having teeth with a blocking side adapted to engage and be parallel to a side of a rectangular ratchet tooth, it is difficult to avoid binding when engaging the pawls with, and releasing the pawls from, the ratchet. According to the present invention, however, it has been found that with careful empirical design and spacing of the pawl teeth, when combined with precise location of the pivot pin or pins of the pawls, it is possible to use pivoting pawls with either three or four teeth without any binding of the pawl teeth when engaging with and releasing from the ratchet.

It is an important aim of the invention to provide wrenches which are geometrically efficient—that is, which keep the width of the wrench as close as possible to the width of the operating jaw. The ratio of the overall width of the wrench to the size of the nut opening is kept as low as possible.

It is also an object of the invention in a third embodiment to provide a wrench which is a thin as possible.

In order to facilitate quick and easy removal, the wrench of the invention includes means placing the wrench in a neutral mode of operation with both pawls released from engagement with the ratchet. This allows the jaw to rotate freely, without ratcheting, back to its position for removal with the jaw slot aligned with a slot provided in the head.

Even through there are only two pawls, the wrench is reversible. A selection mechanism which uses a reversing switch allows only one of the two pawls to engage the rachet at a time, one for clockwise and the other for counterclockwise rotation of the operating jaw.

With the simplified architecture of the wrench of a preferred embodiment, only five moving parts are required within the wrench casing.

More specifically, a wrench according to the invention includes a casing forming a head having a head aperture at one end. An operating hub or jaw is journaled for rotation in the head aperture and has a nut-engaging opening with a slot extending from the nut-engaging opening to the peripheral surface of the jaw. A ratchet having rectangular ratchet teeth is formed in the peripheral surface from one side of the slot to the other side thereof. A pair of movable ratchet pawls are provided, one for allowing rotation of the hub in the clockwise direction and for blocking rotation in the counterclockwise direction and the other for allowing rotation in the counterclockwise direction and for blocking rotation in the clockwise direction. A single control means is provided for selectively engaging one of the pawls with the ratchet for rotation of the jaw in the clockwise direction or the other of the pawls with the rachet for rotation of the jaw in the counterclockwise direction.

In order that no more than a single pawl be engaged with the ratchet at any one time, the pawls have a sufficient number of pawl teeth that at least one of the teeth is engagable with a ratchet tooth for every rotational position of the jaw. It is preferred that the pawls each have only three pawl teeth. When, however, larger torque loads are to be encountered, pawls with four pawl teeth may be used.

In the preferred embodiment, the pawls are pivoted on a common pin which is located on the longitudinal axis of the tool. The design and spacing of the pawl teeth and the location of the pivot pin make it possible to use pawls with at least three and no more than four pawl teeth without binding of the pawl teeth when engaging with and releasing from the ratchet.

The means for engaging the pawls with the ratchet includes a single V-shaped flat spring member, each arm of which engages a pawl for biasing the pawl towards engagement with the ratchet. The engaging means includes a cam having a first "clockwise" control position for clockwise rotation of the operating jaw. When in this control position, the cam allows the one pawl to engage with the ratchet and thereby block counterclockwise rotation, while blocking the other pawl to keep it out of engagement with the ratchet, thus permitting clockwise rotation. The cam has a second "counterclockwise" control position for counterclockwise rotation of the jaw. In this position, the cam allows the other pawl to engage with the ratchet to block clockwise rotation of the jaw, while blocking the one pawl to keep it disengaged from the ratchet to allow counterclockwise rotation. The cam also has a "neutral" control position blocking both pawls to keep both pawls out of engagement with the ratchet. This permits the operating jaw to rotate freely without ratcheting to facilitate removal of the wrench.

In order to move the cam to its three control positions, a reversing switch handle is mounted on the cam shaft. As the switch handle rotates the cam shaft it moves parallel and closely spaced from one side of the wrench casing. The handle is locked in its control positions by detent means which includes three recesses formed in the wrench casing under the path of the switch handle and a spring biased detent ball mounted on the switch handle. When the switch handle is rotated to a control position, the ball engages in one of the recesses to lock the switch handle and cam in a selected control position.

Although the preferred embodiment is a compact, simple and economical tool with only five operating parts within the casing, a second embodiment provides an even more compact tool with, however, an increase in the number of operating parts within the casing to nine. In the wrench of the second embodiment, the pivoting pawls are pivoted on two separate pivot pins on opposite sides of the tool. The pawls extend crosswise of the tool to engage with the ratchet teeth on the opposite side of the longitudinal axis of the tool. Thus, one pawl, which engages the ratchet in a manner permitting clockwise rotation of the jaw, and blocking counterclockwise rotation thereof, is pivoted on a pin disposed, when the tool is oriented with its open end to the top, on the right side of the tool and with its pawl teeth engagable with the ratchet to the left of the longitudinal axis. The other pawl which permits counterclockwise rotation and blocks clockwise rotation, is pivoted on a pin on the left side of the tool with its pawl teeth engagable with the ratchet to the right side of the longitudinal axis.

The pawls are biased towards engagement with the ratchet by a pair of V-shaped flat spring members. The spring member for the one pawl has a first arm received in a slot formed in the right side of the casing and a second arm pressing against the one pawl. Likewise, the spring member for the other pawl has a first arm received in a slot formed in the left side of the casing and a second arm pressing against the other pawl.

Selection of the direction of rotation of the operating hub in the second embodiment is governed by a selector switch which rotates a pulley. The pulley is connected to a first cable coupled to the one pawl and to a second cable coupled to the other pawl. When the pulley is rotated to a first control position for clockwise rotation of the hub, the one pawl is engaged with the ratchet and the other pawl is pulled out of engagement with the ratchet. A second neutral control position of the pulley pulls both pawls out of engagement with the ratchet permitting the hub to rotate freely without ratcheting to facilitate removal of the wrench. When the pulley is rotated to a third control position for counterclockwise rotation of the hub, the other pawl is brought into engagement with the ratchet and the one pawl is pulled out of engagement with the ratchet.

In order to retain the pulley in a selected control position, the pulley has a retaining collar having three flat surfaces. A flat retaining spring presses against the retaining collar, engaging with a respective flat surface of the retaining collar for each of the three control positions of the pulley.

The second embodiment also uses only two ratchet pawls only one of which engages the ratchet at any one time. The design and spacing of the pawl teeth, which have a radial side and a sloped side, and the location of the pivot pins make it possible to use pawls with at least three and no more than four pawl teeth without binding of the pawl teeth when engaging with or releasing from the ratchet. It is preferred that each pawl have only three pawl teeth, but in applications requiring large torque loads a four pawl teeth version may be used. However, when the second embodiment employs pawls with four pawl teeth, the neutral mode of operation is not possible.

According to a third embodiment of the invention, reciprocating pawls are used moving in parallel guide means which are parallel with the longitudinal axis of the wrench. A single control is used employing linkage means to move the pawls into and out of engagement with the ratchet. In order to keep the tool as narrow as possible, the pawls, guide means, and control means are all closer to the longitudinal axis of the wrench than the lateral extent of the jaw. To keep the tool as thin as possible, the pawls and ratchet are as thin as possible and in the same plane. The third embodiment uses a retention collar with three flat surfaces and a retention spring to hold the control positions of a control shaft.

BRIEF DESCRIPTION OF THE DRAWINGS

A clearer understanding of the invention will be apparent from the following description and drawings, wherein.

DETAILED DESCRIPTION

Figure 2:
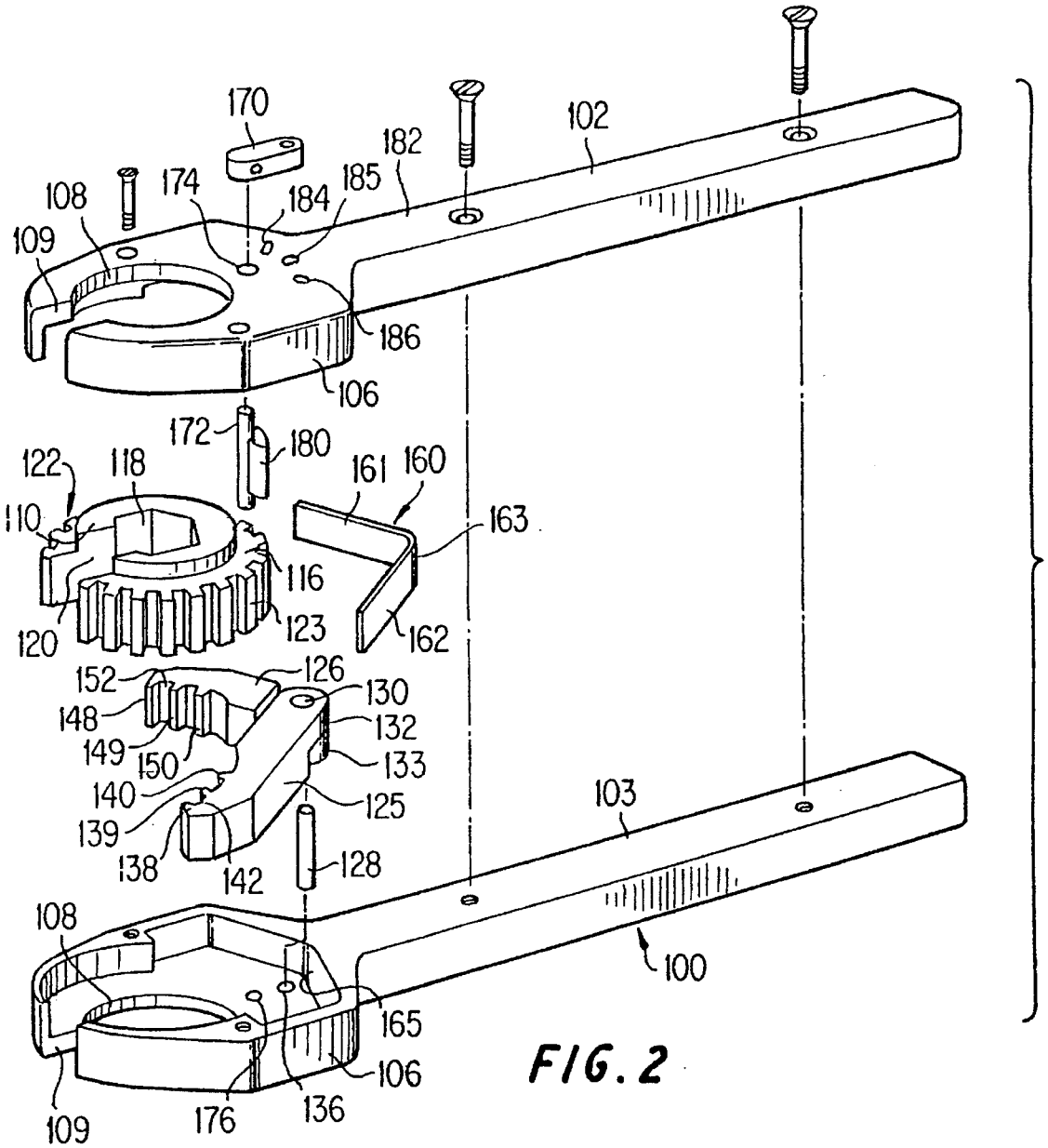
FIG. 2 is an exploded view of the embodiment of FIG. 1.
Figure 1:
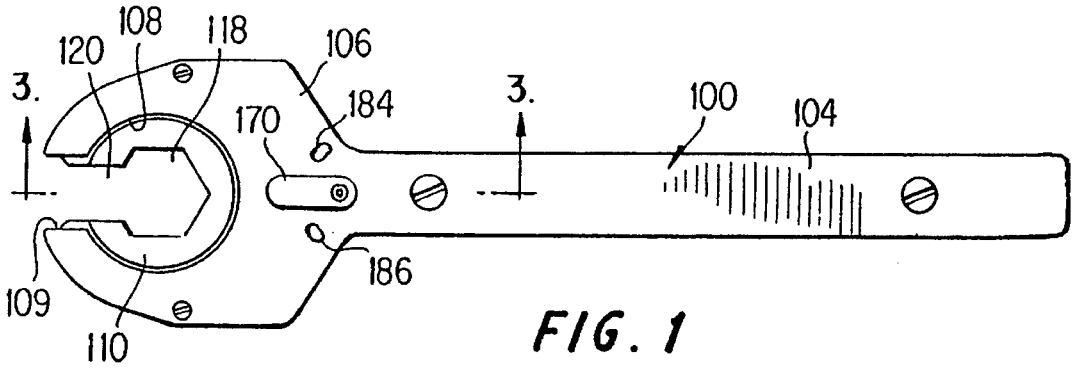
FIG. 1 is a plan view of a preferred embodiment of the invention.
Figure 3:
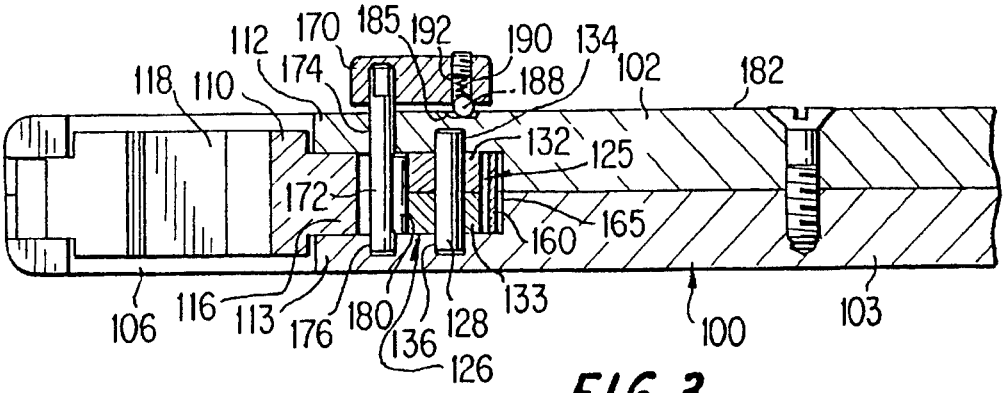
FIG. 3 is a partial enlarged section view taken along the line 3—3 of FIG. 1.
Figure 4:
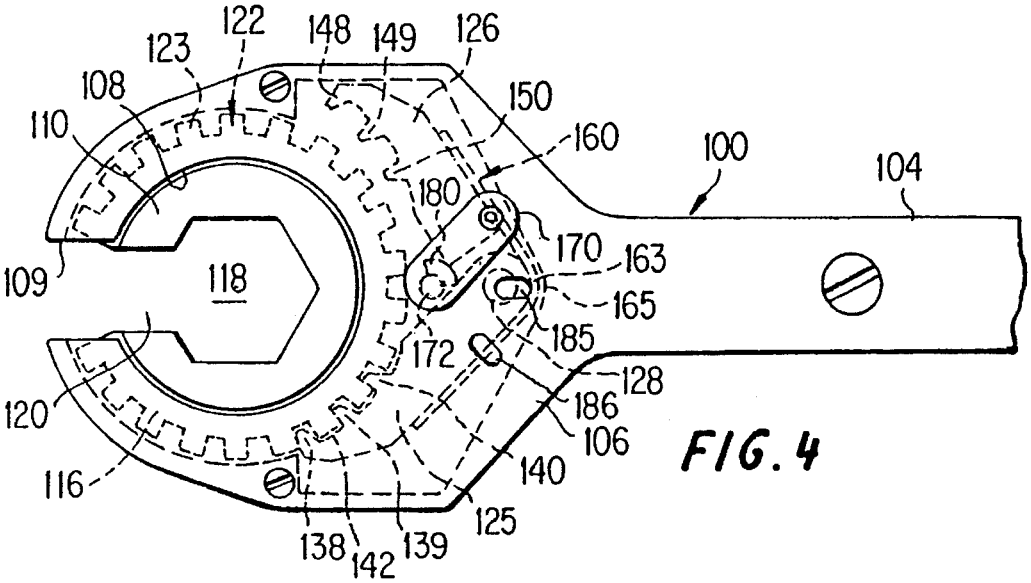
FIG. 4 is a partial enlarged plan view with concealed parts shown in dash line of the embodiment of FIG. 1.
Figure 7:
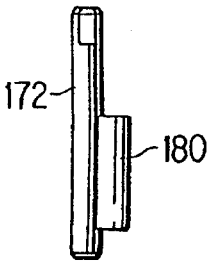
FIG. 7 is a side elevation view of a cam shaft and cam assembly of the embodiment of FIG. 1.
Figure 5:
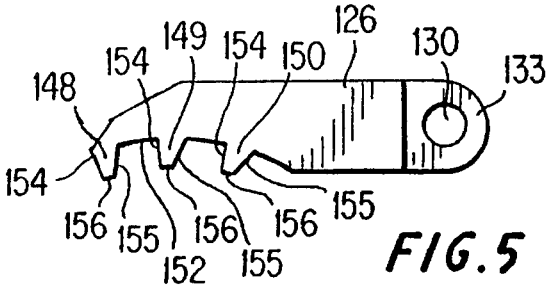
FIG. 5 is a plan view of a ratchet pawl of the embodiment of FIG. 1.
Figure 8:
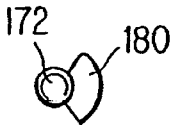
FIG. 8 is an end view of the cam shaft and cam assembly of FIG. 7.
Figure 6:
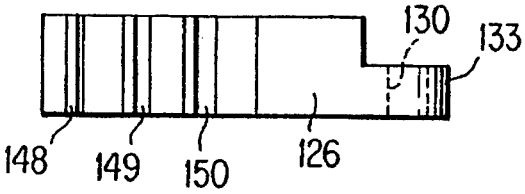
FIG. 6 is a side view of the rachet pawl of FIG. 5.
Figure 11:
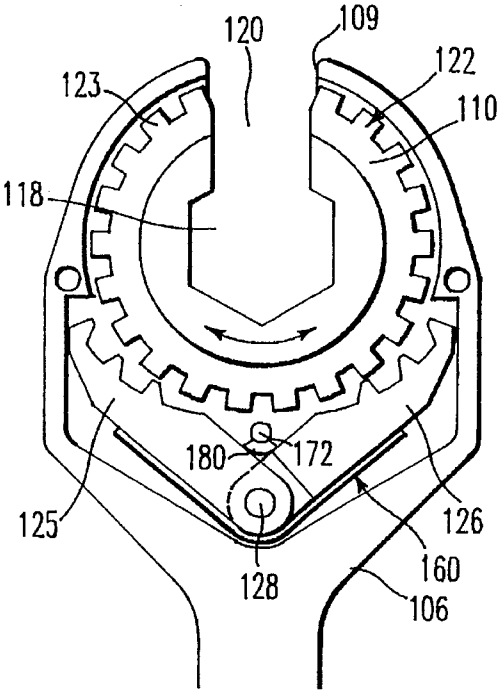
FIGS. 9–11 are partial enlarged plan views with part of the casing broken away showing the embodiment of FIG. 1 in its "clockwise", "counterclockwise" and "neutral" modes, respectively.
Figure 2A:
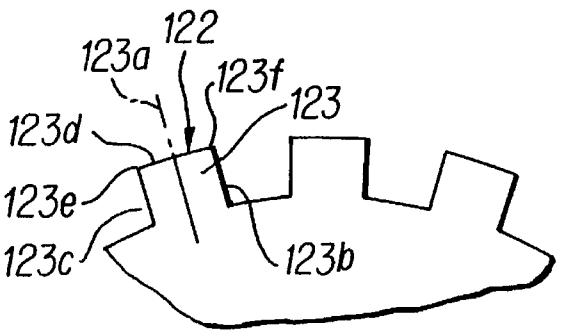
FIG. 2A is a partial enlarged view.

A preferred embodiment of the invention is shown in FIGS. 1–11. As seen in these figures, a wrench 100 of the invention includes upper and lower casing members 102 and 103 forming an elongated handle 104 and a head 106 at one end. The head has an aperture 108 opened to the end of the tool by a slot 109. An operating hub or jaw 110 is journaled for rotation in aperture 108. Turning to the section view of FIG. 3, it will be seen that casing parts 102 and 103 are reduced in thickness to form bearing shoulders 112 and 113 which extend around aperture 108 to slot 109. Bearing shoulders 112 and 113 establish space for a bearing collar 116 formed on the periphery of jaw 110. As seen most clearly in FIGS. 1, 2, 4, 9, 10 and 11, jaw 110 has a nut engaging opening 118 of hexagonal configuration, and opening 118 is opened by a slot 120 to the periphery of jaw 110. A ratchet 122 is formed on jaw 110 by a series of rectangular ratchet teeth 123 formed with equal spacing on collar 116 and extending from one side of slot 120 to the other side thereof. As shown in FIG. 2A, rectangular ratchet teeth 123 have a center line **123*a* which is radial to the jaw, a side 123*b* facing in the clockwise direction, a side 123*c* facing in the counterclockwise direction, both sides being parallel to radial center line 123*a*, and a top side 123*d* which is perpendicular to sides 123*b* and 123*c*. The corners 123*e* and 123*f* between top side 123*d* and sides 123*b* and 123*c* are curved at a radius of 0.005 inch, for example. It will be understood that despite the rounded corners 123*e* and 123*f*, ratchet teeth 123 are described in this specification and claims as "rectangular". While ratchet tooth sides 123*b* and 123*c* are not, strictly speaking, "radial", in the specification and claims the term "generally radial" is considered as encompassing sides 123*b* and 123*c* which are, in fact, parallel to the radial center line 123*a* of ratchet teeth 123. It will be observed that slot 109 formed in head 106 is slightly wider than slot 120 formed in jaw 110. With slots 109 and 120 in alignment as shown in FIGS. 1, 4, and 11**, the tool is easily slipped endwise onto a bolt, or the like, for ready engagement with a nut thereon.

Figure 10:
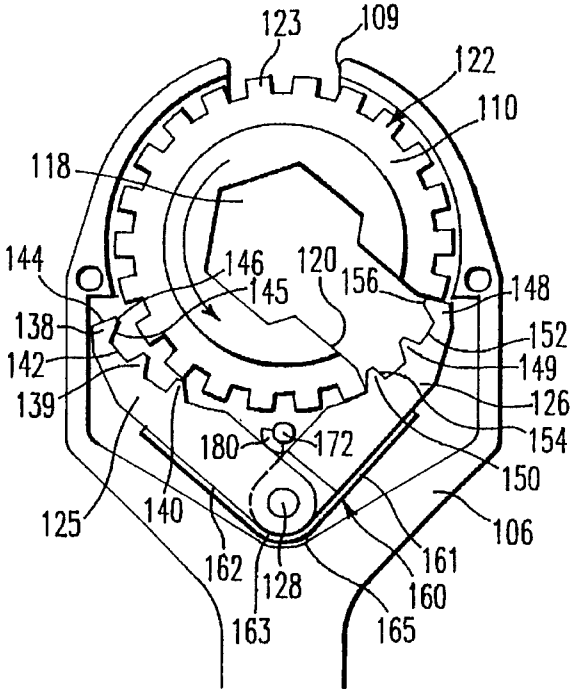
Figure 9:
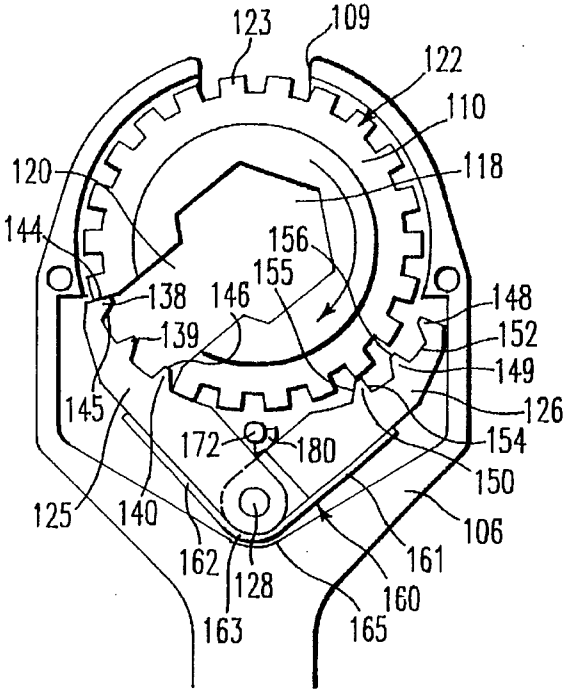

From FIGS. 2, 4, 9, 10 and 11, it will be seen that two pawls 125 and 126 are pivoted on a common pivot pin 128 located on the longitudinal axis of the tool. Pin 128 extends through holes 130 in the heels 132 and 133 of pawls 125 and 126 and is seated in aligned bores 134 and 136 in bearing shoulders 112 and 113, respectively, as seen in FIG. 3. Pawl 125 has three pawl teeth 138, 139 and 140 projecting from an arcuate surface 142, the radius of which is lightly larger than the radius of rotating jaw 110. The three teeth 138, 139 and 140 are spaced with the same pitch as ratchet teeth 123 of ratchet 122. As shown in FIGS. 9–11, each tooth has a blocking side 144 which extends generally radially of rotating jaw 110 when engaged with ratchet 122, being parallel to the abutted side of the ratchet tooth, and a sloping side 145 which is sloped at an angle of 28° with this generally radial direction. The tips 146 of the pawl teeth lie along an arcuate surface, the radius of which is smaller by the height of teeth 138, 139 and 140 than the radius of arcuate surface 142. Pawl 125 engages ratchet 122 for clockwise rotation of jaw 110. As seen in FIG. 9, when so engaged, the blocking sides 144 of teeth 138, 139 and 140 abut and are parallel to generally radial sides of ratchet teeth 123 to block rotation in the counterclockwise direction. For rotation in the clockwise direction, on the other hand, ratchet teeth 123 slip over sloped sides 145 of teeth 138, 139 and 140. Pawl 126, which pivots on pin 128 with its heel 133 just below heel 132 of pawl 125, has three pawl teeth 148, 149 and 150 and is configured as a mirror image of pawl 125. Whereas the blocking sides 144 of teeth 138, 139 and 140 of pawl 125 face in the clockwise direction, the blocking sides 154 of pawl teeth 148, 149 and 150 face in the counterclockwise direction. Sloped sides 155 of teeth 148, 149 and 150, which face in the clockwise direction, arcuate surface 152, and tooth tops 156 are shaped according to the same principles as sloped sides 145, arcuate surface 142 and tooth tops 146 of pawl 125. When pawl 126 engages ratchet 122 for counterclockwise rotation, as shown in FIG. 10, blocking sides 154 of teeth 148, 149 and 150 abut and are parallel to the clockwise facing side of ratchet teeth 123, so that rotation in the clockwise direction is blocked. Rotation in the counterclockwise direction is permitted as ratchet teeth 123 slip over the sloped sides 155 of the teeth of pawl 126.

Pawls 125 and 126 are biased by a flat spring member 160 towards engagement with ratchet 122. Spring member 160 is V-shaped, having arms 161 and 162 connected by an arcuate portion 163. As shown in FIGS. 4, 9, 10 and 11, arcuate portion 163 of spring 160 is positioned between the heels of 132 and 133 of pawls 125 and 126 and an arcuate wall 165 formed on casing parts 102 and 103 between shoulders 112 and 113. Arm 162 bears against a side of pawl 125 and biases it toward jaw 110; and arm 161 bears against a side of pawl 126, biasing it toward jaw 110.

The wrench includes means for selecting the direction of rotation of jaw 110 or a neutral mode of operation permitting rotation freely in both directions. A reversing switch handle 170 is mounted on a shaft 172 journaled in a bore 174 through bearing shoulder 112 and a bore 176 in bearing shoulder 113. A cam 180 is formed on shaft 172. Detent means are provided to lock reversing switch handle 170 and cam 180 in one of three control positions for selecting one of three modes of operation: a "clockwise" mode for clockwise rotation of law 110, "counterclockwise" mode for counterclockwise rotation of jaw 110, or a "neutral" mode for disengaging ratchet 122 from both pawls for free rotation of jaw 110. Reversing switch handle 170 swings in a plane parallel to a side 182 of casing part 102 over three locking notches 184, 185 and 186 (See FIG. 2). A detent ball 188 is biased by a spring 190 within a bore 192 provided in switch handle 170 into engagement with casing side 182. As switch handle 170 is rotated, ball 188 is brought into engagement with one of the lock notches 184, 185 and 186 to select a mode of operation of the wrench.

As shown in FIG. 9, when detent ball 188 is engaged in locking notch 184, the position for the "clockwise" mode of operation, cam 180 is rotated to a position in which it blocks pawl 126, keeping the pawl out of engagement with ratchet 122. Pawl 125, being unblocked by the cam, is biased by spring arm 162 into engagement with ratchet 122. Since the blocking sides 144 of pawl teeth 138, 139 and 140 face in the clockwise direction, they abut and are parallel to generally radial sides of ratchet teeth 123 and block counterclockwise rotation of jaw 110. Clockwise rotation, however, is not blocked; ratchet teeth 123 are free to slip over the sloped sides 145 of pawl teeth 138, 139 and 140; and jaw 110 can rotate in the clockwise direction.

Turning to FIG. 10, when reversing switch handle 170 is rotated to bring detent ball 188 into engagement with locking notch 186, the position for the "counterclockwise" mode, cam 180 is in position to block pawl 125, keeping it out of engagement with ratchet 122. Pawl 126, on the other hand, is not blocked by cam 180 and is biased by spring arm 161 into engagement with ratchet 122. With pawl 126 engaged with ratchet 122, the blocking sides 154 of teeth 148, 149 and 150 of pawl 126, which face in the counterclockwise direction, block rotation of jaw 110 in the clockwise direction. Because ratchet teeth 123 can slip over the sloped sides 155 of pawl teeth 148, 149 and 150, rotation in the counterclockwise direction is permitted.

As illustrated in FIG. 11, when reversing switch handle 170 is positioned with detent ball 188 engaged with locking notch 185, the position for the "neutral" mode, cam 180 is so positioned that both pawls 125 and 126 are blocked from engagement with ratchet 122. Since neither pawl is engaged with ratchet 122, it is not blocked for rotation in either direction, but allows jaw 110 to rotate freely without ratcheting in either direction. This facilitates quick and easy removal of the wrench.

Figure 12:
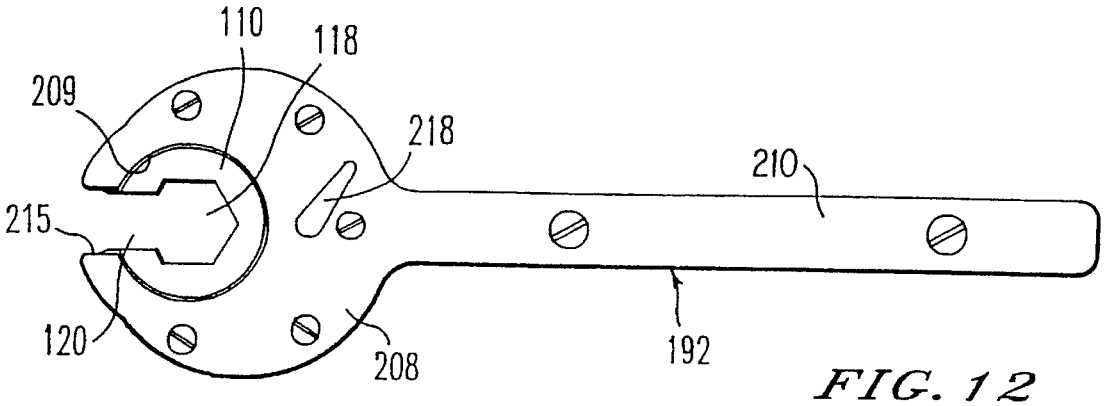
FIG. 12 is a plan view of a four teeth pawl version of the embodiment of FIG. 1.
Figure 13:
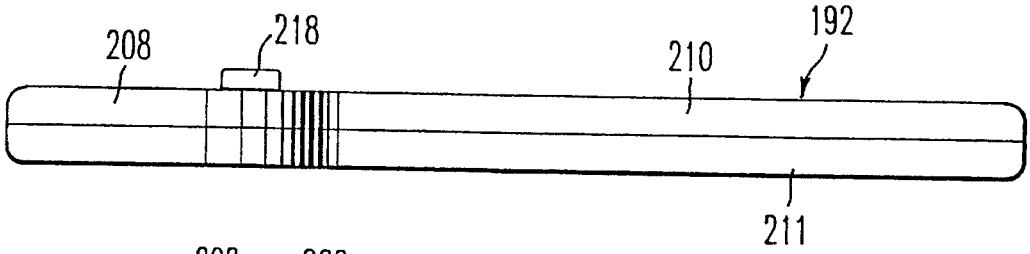
FIG. 13 is a side elevation view of the device of FIG. 12.
Figure 14:
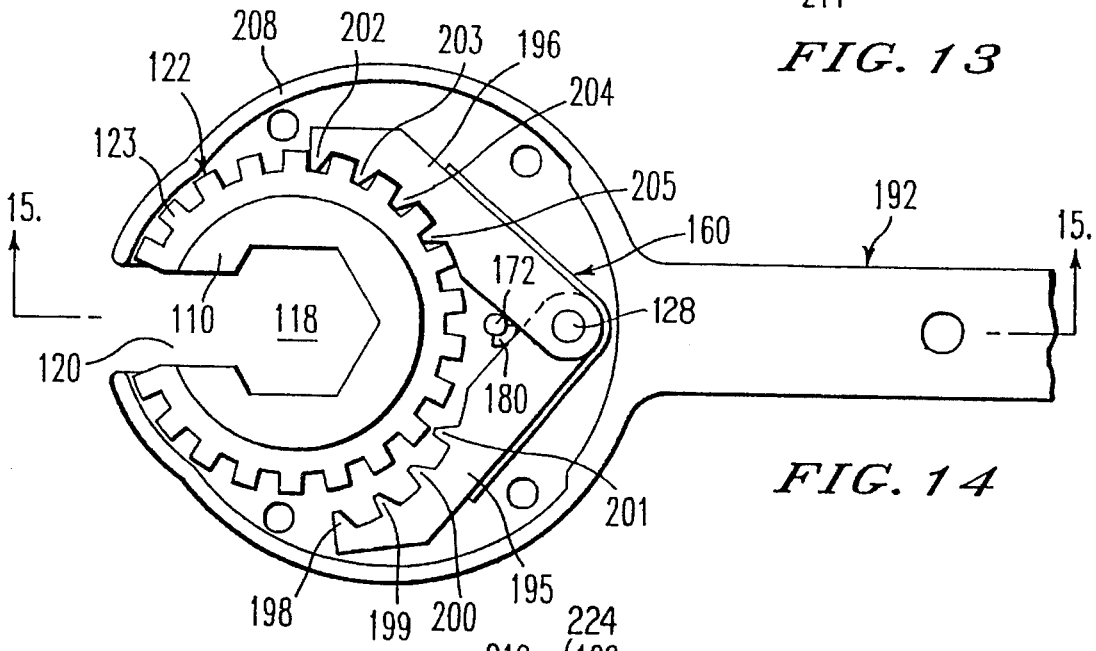
FIG. 14 is a partial enlarged plan view with part of the casing broken away of the device of FIG. 12.
Figure 15:
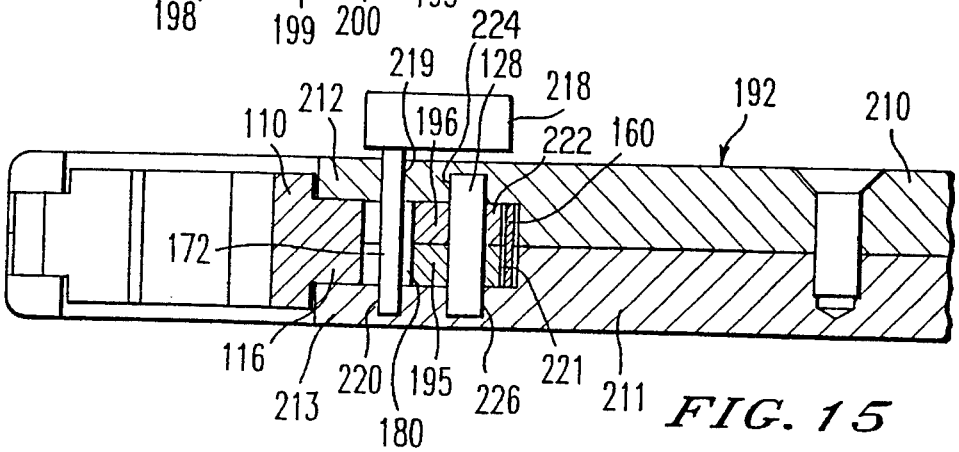
FIG. 15 is a partial section view taken on the line 15—15 of FIG. 14.

While the just described wrench will be satisfactory for most applications, there will be some occasions with large torque requirements when a wrench with greater strength is desirable. A wrench 192 using pawls 195 and 196 with four pawl teeth, as shown in FIG. 14, will be useful in such situations. The pawl 195, which engages ratchet 122 for clockwise rotation has four pawl teeth 198, 199, 200 and 201 which are otherwise shaped and configured in the same manner as the pawl teeth 138, 139 and 140 of the three pawl teeth version of FIGS. 1–11. Likewise, pawl 196, which engages ratchet 122 for counterclockwise rotation has four pawl teeth 202, 203, 204 and 205 configured in the same manner as the pawl teeth 148, 149 and 150 of pawl 126. As seen in FIGS. 12 and 14, wrench 192 has a head 208 which is wider than head 106 of the wrench of FIGS. 1–11 to accommodate the longer four teeth pawls 195 and 196. Head 208 has a head aperture 209 in which jaw 110 is journaled. Wrench 192 is formed of two housing parts 210 and 211 which, as seen in FIG. 15 include bearing shoulders 212 and 213, respectively, between which the jaw bearing collar 116 is received. Head 208 has a slot 215 which opens head aperture 209 to the end of the tool. Slot 215 is slightly wider than jaw slot 120 with which it may be aligned as shown in FIGS. 12 and 14. The direction of rotation is selected by switch handle 218 mounted on cam shaft 172 on which cam 180 is formed. Shaft 172 is journaled in a bore 219 through bearing shoulder 212 and in a bore 220 in bearing shoulder 213. The four teeth pawl version of the preferred embodiment, as shown in FIGS. 12–15, is otherwise essentially the same as the three teeth pawl version of FIGS. 1–11 and like parts are identified by the same reference numbers. Thus, pawls 195 and 196 are pivoted on a common pivot pin 128 and are biased towards engagement with ratchet 122 by spring 160. Pivot pin 128 extends through aligned holes in the heels 221 and 222 of pawls 195 and 196 and is journaled in bores 224 and 226 in bearing shoulders 212 and 213. Engagement of pawls 195 and 196 is selectively blocked by cam 180 by adjusting the position of switch handle 218.

In both the three pawl teeth and four pawl teeth versions of the preferred embodiment, the spacing of the pawl teeth is such that at least one pawl tooth is engagable with a ratchet tooth for every rotational position of jaw 110, including positions in which the gap provided by jaw slot 120 confronts one of the pawls. In both versions, only one pawl is engaged with ratchet 122 for each direction of rotation of jaw 110. The design and spacing of the pawl teeth and the location of pivot pin 128 make it possible for pawls with three and four pawl teeth to engage with and release from ratchet 122 without binding.

In a best mode of the preferred embodiment of FIGS. 1–11, slot 109 has a width of 0.45 inch, and slot 120 is 0.39 inch wide. Ratchet teeth 123 are rectangular with generally radial sides which are parallel to the radial center lines of the teeth and are 0.1 inch in width and 0.075 inch in height. Twenty-two ratchet teeth are equally spaced around the circumference of jaw 110 from one side of slot 120 to the other side thereof with a pitch of 16°22' of arc. The diameter of jaw 110 is 1.375 inches (a 0.6875 inch radius). The teeth 138, 139 and 140 of pawl 125 and 148, 149 and 150 of pawl 126 are spaced with the same 16°22' of arc pitch as ratchet teeth 123. Pawl teeth 138, 139 and 140 of pawl 125 project from an arcuate surface 142 with a radius of 0.697 inches (using the center of jaw 110), while the surface defined by the tips 156 of the pawl teeth define an arcuate surface with a radius 0.075 inch smaller (a 0.622 inch radius). The spacing between the teeth along surface 142 is 0.11 inch, and the width of tooth tips 156 is 0.025 inch.

Pawl teeth 138, 139 and 140 have a blocking side 144 which, when engaged with ratchet 122, extends parallel to the engaged side of a ratchet tooth. The sloped side 145 of the teeth extends at an angle of 28° with blocking side 144. Pawl 126 is configured as a mirror image of pawl 125 with all of the above dimensions otherwise identical. The center of common pivot pin 128 of pawls 125 and 126 is located 1.032 inch from the center of jaw 110.

For the four pawl tooth version, the shape, tooth spacing and dimensions of the pawls are identical. However, the center of common pivot pin 128 is located 1.075 inch from the center of jaw 110.

Figure 16:
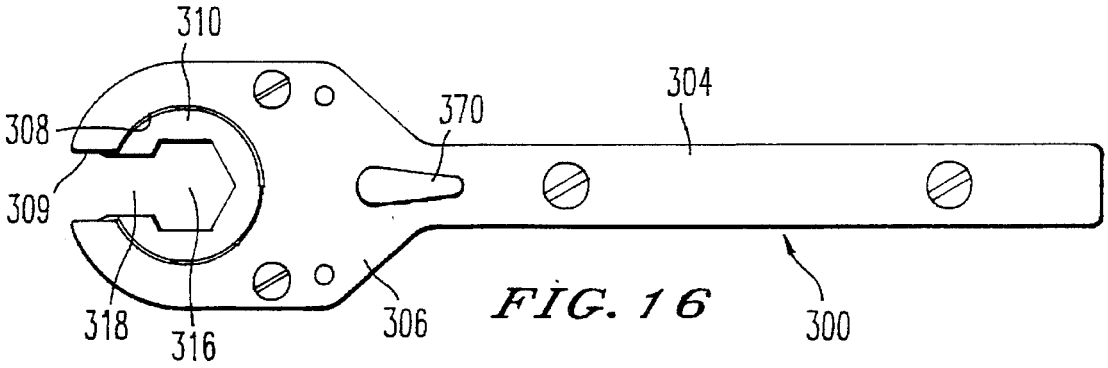
FIG. 16 is a plan view of a second embodiment of the invention.
Figure 17:
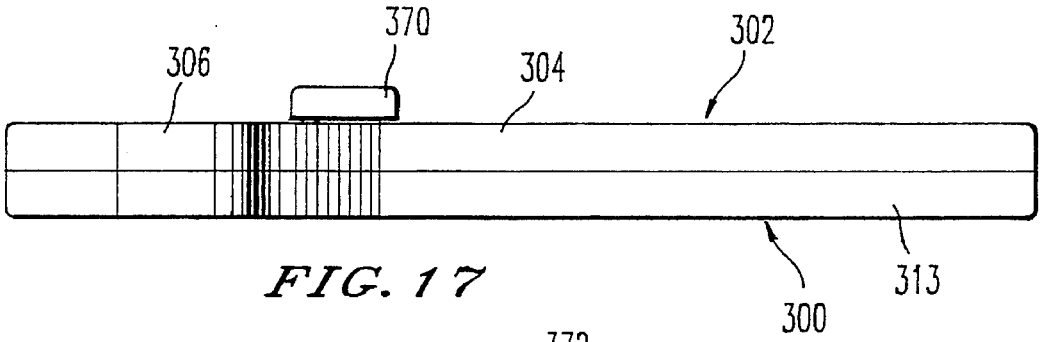
FIG. 17 is a side elevation view of the embodiment of FIG. 16.
Figure 21:
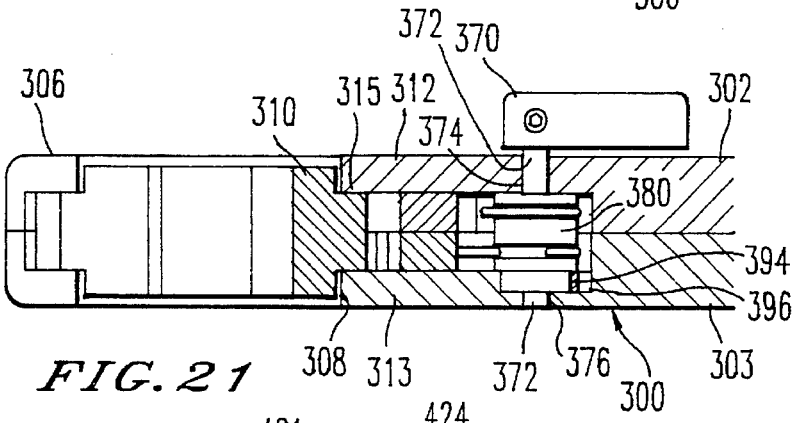
FIG. 21 is a partial section view taken along the lines 21—21 of FIG. 20.

A more compact wrench embodiment is shown in FIGS. 16–24. As seen in FIG. 16, the wrench 300 is formed with two casing parts 302 and 303 which form an elongated handle 304 and a head 306. A head aperture 308 is formed in head 306 and is connected by a head slot 309 to an open end of the head. An operating jaw 310 is journaled for rotation in aperture 308. As seen in FIG. 21, casing part 302 includes a bearing shoulder 312, and casing part 303 includes a bearing shoulder 313. These shoulders form a space for receiving a bearing collar 315 formed on the peripheral surface of jaw 310.

Figure 20:
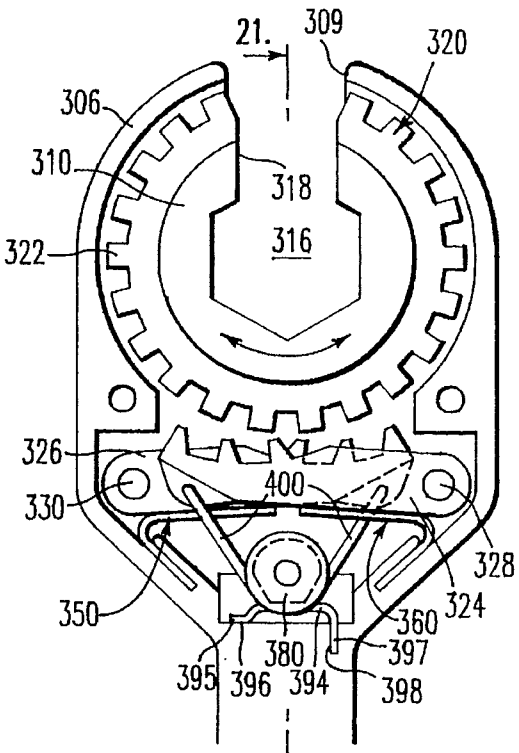
FIGS. 18–20 are enlarged partial plan views with part of the casing broken away showing the embodiment of FIG. 16 in its "clockwise", "counterclockwise", and "neutral" modes, respectively.
Figure 19:
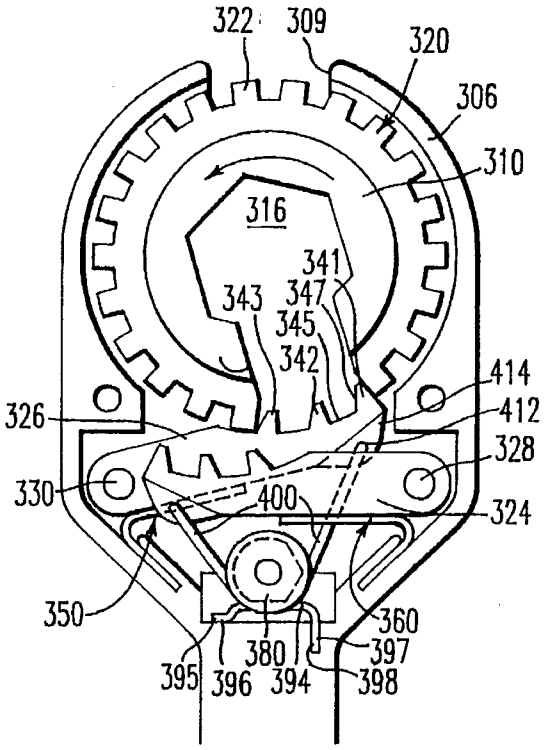
Figure 18:
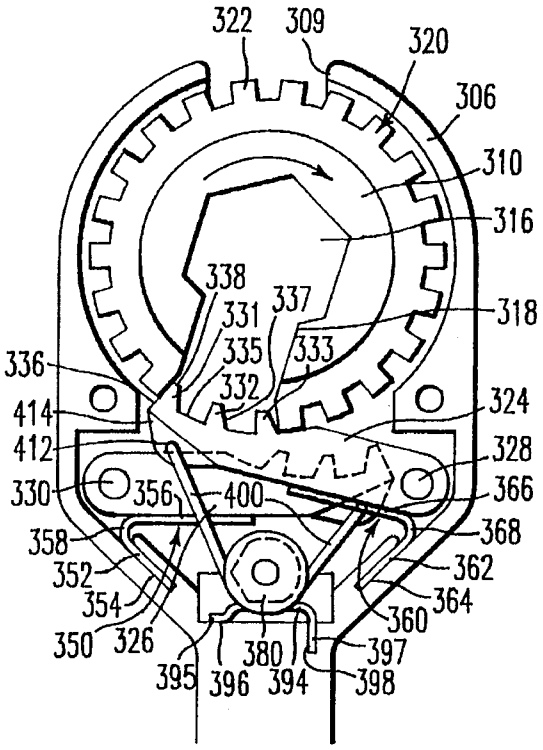

As seen in FIGS. 18–20, rotating jaw 310 has a hexagonal nut-engaging opening 316 which is opened by a slot 318 extending from the periphery of jaw 310. A ratchet 320 is formed of rectangular ratchet teeth 322 on collar 315. These teeth are uniformly spaced about collar 315 from one side of slot 318 to the other side thereof. Typically, twenty-two ratchet teeth are used with a width of 0.1 inch and an arcuate spacing of 16°22'. Slot 318 is slightly narrower than slot 309, typically having widths of 0.39 inch and 0.45 inch respectively. With the slots aligned as shown in FIG. 20, wrench 300 can be radially engaged endwise on a bolt or the like for easy engagement with a nut.

In order to control the direction of rotation of jaw 310, a pair of ratchet pawls 324 and 326 are provided. Pawl 324 is pivoted on a pivot pin 328 on the right side of the head, as viewed with the open end 309 of the head at the top, and extends crosswise of the head to be engagable with ratchet 320 on the other side of the longitudinal axis of the tool. On the other hand, pawl 326 is pivoted on a pivot pin 330 located on the left side of the head and extends crosswise of the head just below pawl 324 to be engagable with ratchet 320 on the right side of the longitudinal axis.

For engagement with ratchet 320, pawl 324 has three pawl teeth 331, 332 and 333 projecting from an arcuate surface 335. When engaged with ratchet 320, pawl teeth 331, 332 and 333 have a blocking side 336 facing in a direction clockwise of jaw 310 and extending parallel to the engaged side of a ratchet tooth. The opposite sides 337 of these teeth face in a direction counterclockwise of jaw 310 and are sloped at an angle of 28° with blocking side 336. By virtue of this configuration, when pawl 324 is engaged with ratchet 320, blocking sides 336 abut and are parallel to the facing generally radial sides of ratchet teeth 322 to block counterclockwise rotation of jaw 310. The sloped sides 337 of pawl teeth 331, 332 and 333 permit ratchet teeth 322 to slide thereover. Rotation in the clockwise direction is thus permitted as illustrated in FIG. 18. Pawl teeth 331, 332 and 333 have narrow tips 338 which fall on the same arcuate surface.

Pawl 326 has three pawl teeth 341, 342 and 343 projecting from arcuate surface 345 and having blocking sides 346 facing counterclockwise of jaw 310 and sloped sides 347 facing clockwise thereof. Thus, when engaged with ratchet 320, pawl teeth 341, 342 and 343 will block clockwise rotation and permit counterclockwise rotation of jaw 310 as shown in FIG. 19. Teeth 341, 342 and 343 have narrow tips 348 which fall on the same arcuate surface.

Pawl 326 is biased by a V-shaped flat spring 350 towards engagement with ratchet 320. Spring 350 has a shorter arm 352 received in a slot 354 provided in the casing, a longer arm 356 which bears against pawl 326 on the side opposite to teeth 341, 342 and 343, and an arcuate connecting portion 358. Likewise, a V-shaped flat spring 360 has a short arm 362 received in a slot 364 formed in the casing, a long arm 366 bearing against pawl 324 to bias it toward engagement with ratchet 320, and an arcuate connecting portion 368.

Figure 22:
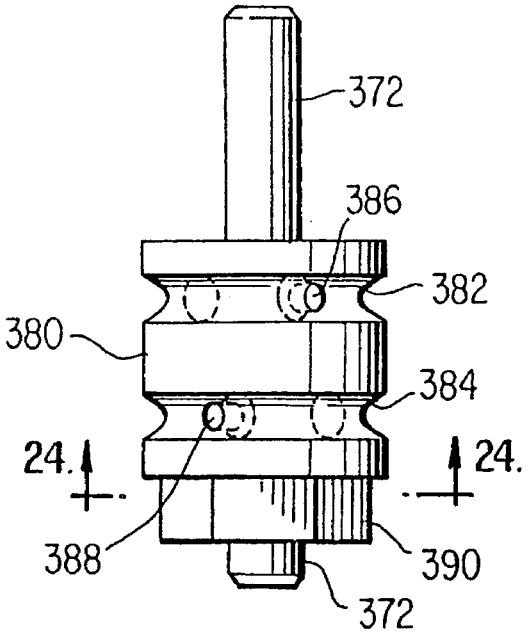
FIG. 22 is a side view of a pulley of the embodiment of FIG. 16.
Figure 23:
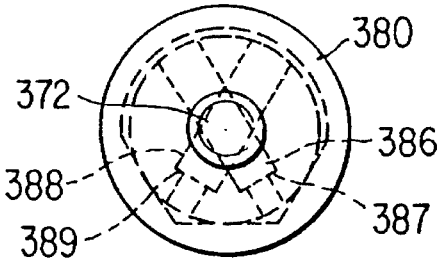
FIG. 23 is an end view of the pulley of FIG. 22.

In order to select the mode of operation of wrench 300, a reversing switch handle 370 is provided above casing side 302 for rotating a shaft 372, as best seen in FIG. 21. Shaft 372 is journaled in a bore 374 extending through shoulder 312 and in a bore 376 through shoulder 313. A pulley 380 is mounted on shaft 372 between shoulders 312 and 313. As seen in FIG. 22, pulley 380 has a pair of cable receiving grooves 382 and 384. A cable anchoring bore 386 extends diametrically through pulley 380 from groove 382, and a second cable anchoring bore 388 extends diametrically through pulley 380 from groove 384. A stop shoulder 387 is formed in bore 386, and a stop shoulder 389 is formed in bore 388.

Figure 24:
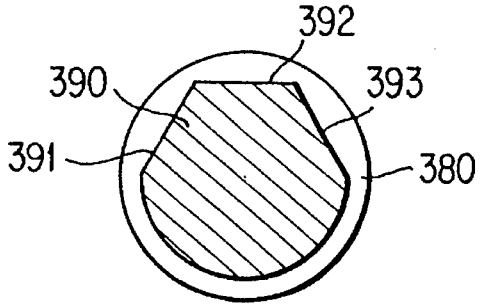
FIG. 24 is a section view taken along the lines 24—24 of FIG. 22.
Figure 25:
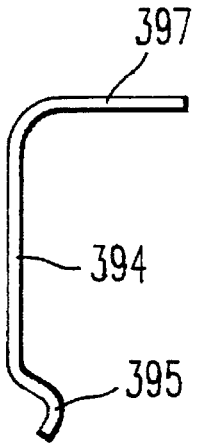
FIG. 25 is a side view of a spring used in the embodiment of FIG. 16.

For retaining pulley 380 in a selected position, it has, as seen in FIGS. 22 and 24 a retaining collar 390 having three flat surfaces 391, 392 and 393 which collectively extend over just less than half the circumference of pulley 380. Typically, each surface 391, 392 and 393 has an arcuate length of 58°30'. These surfaces cooperate with a flat spring 394 (see FIGS. 18, 19 20 and 25) which has a curved bearing foot 395 pressing against a wall 396 formed in the casing and a perpendicular arm 397 received in a slot 398 formed in the casing. Spring 394 presses against retaining collar 390. When pulley 380 is rotated to bring a flat surface 391, 392 or 393 into engagement with spring 394, it will be retained in its rotational position by virtue of the pressure of spring 394 against the flat surface.

Figure 26:
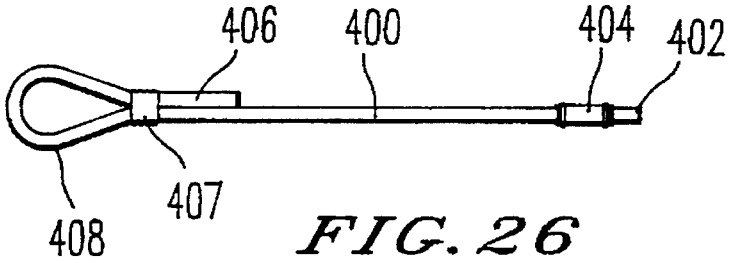
FIG. 26 is a plan view of a cable with an oval sleeve omitted used in the embodiment of FIG. 16.
Figure 27:
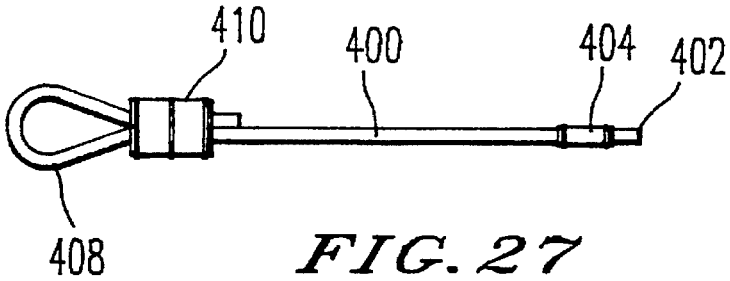
FIG. 27 is a plan view of a cable with the oval sleeve applied used in the embodiment of FIG. 16.

As seen in FIGS. 26, and 27 a pair of cables 400 are provided to couple pulley 380 to the respective pawls 324 and 326. Cable 400 is a galvanized cable with an end 402 on which a stop sleeve 404 is mounted. The other end 406 is soldered with silver solder 407 to form a loop 408. As seen in FIG. 27, an oval sleeve 410 is slipped over the solder joint.

The ends 402 of cables 400 are received in respective bores 386 and 388 in pulley 380 with stop sleeves 404 engaging respective shoulders 387 and 389 to anchor the cables to the pulley. As seen in FIGS. 18–20, the loops 408 are connected to respective pawls 324 and 326 by being threaded through an aperture 412 provided on a tab 414.

Reversing switch 370 has three operating positions for selecting a mode of operation. In one position for the "clockwise" mode, pulley 380 is rotated to engage pawl 324 with ratchet 320 and pull pawl 326 away from ratchet 320, as shown in FIG. 18, and is retained in this position by the engagement of spring 394 against flat surface 391. The wrench, when in this "clockwise" mode, permits clockwise rotation of jaw 310 and blocks counterclockwise rotation. In the "counterclockwise" mode shown in FIG. 19, pulley 380 is rotated to pull pawl 324 away from ratchet 320 and to engage pawl 326 with ratchet 320, being retained in this position by spring 394 bearing on flat surface 393. When in this mode, counterclockwise rotation of jaw 310 is permitted, but clockwise rotation is blocked. In the "neutral" mode shown in FIG. 20, pulley 380 is rotated to pull both pawl 324 and pawl 326 away from ratchet 320 and is retained in its position by the pressure of spring 394 against flat surface 392. In this neutral mode, jaw 310 is free to move without ratcheting in either direction permitting easy removal of the wrench.

Figure 28:
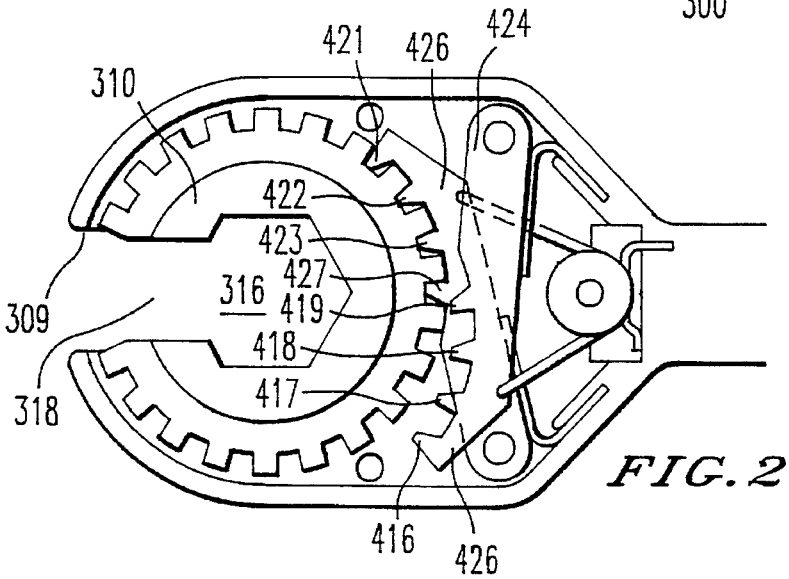
FIG. 28 is a partial plan view with part of the casing broken away of a four teeth pawl version of the embodiment of FIG. 16.

When greater strength is required, a four teeth pawl version of the embodiment of FIGS. 16–27 may be employed as shown in FIG. 28. Here pawls 424 and 426 each have four pawl teeth. The pawl teeth 416, 417, 418 and 419 on pawl 424 are designed, when engaged with ratchet 320, to permit clockwise rotation of jaw 310 and to block counterclockwise rotation thereof. The pawl teeth 421, 422, 423 and 427 of pawl 426 are designed to permit counterclockwise rotation of jaw 310 and to block clockwise rotation of the jaw. It is to be noted, however, that the four teeth pawl version of the second embodiment of the wrench cannot be placed in the neutral mode. Due to the geometry of the four teeth pawls, it is not possible to bring both pawls completely clear of engagement with rachet 320 at the same time.

In both versions of the second embodiment, only a single pawl is engaged with rachet 320 at any one time. For all rotational positions of jaw 310, at least one pawl tooth is engagable with the ratchet. The design and spacing of the pawl teeth and the location of the pivot pins make is possible to use pawls with at least three and no more than four pawl teeth without binding of the pawl teeth when engaging with and releasing from ratchet 320. For the most part, the geometry of the pawl teeth in the second embodiment follows the same principles as those used in the above described best mode of the preferred embodiment. The pivot pins 328 and 330 are typically 1.032 inch from the center of rotating jaw 310.

Figure 29:
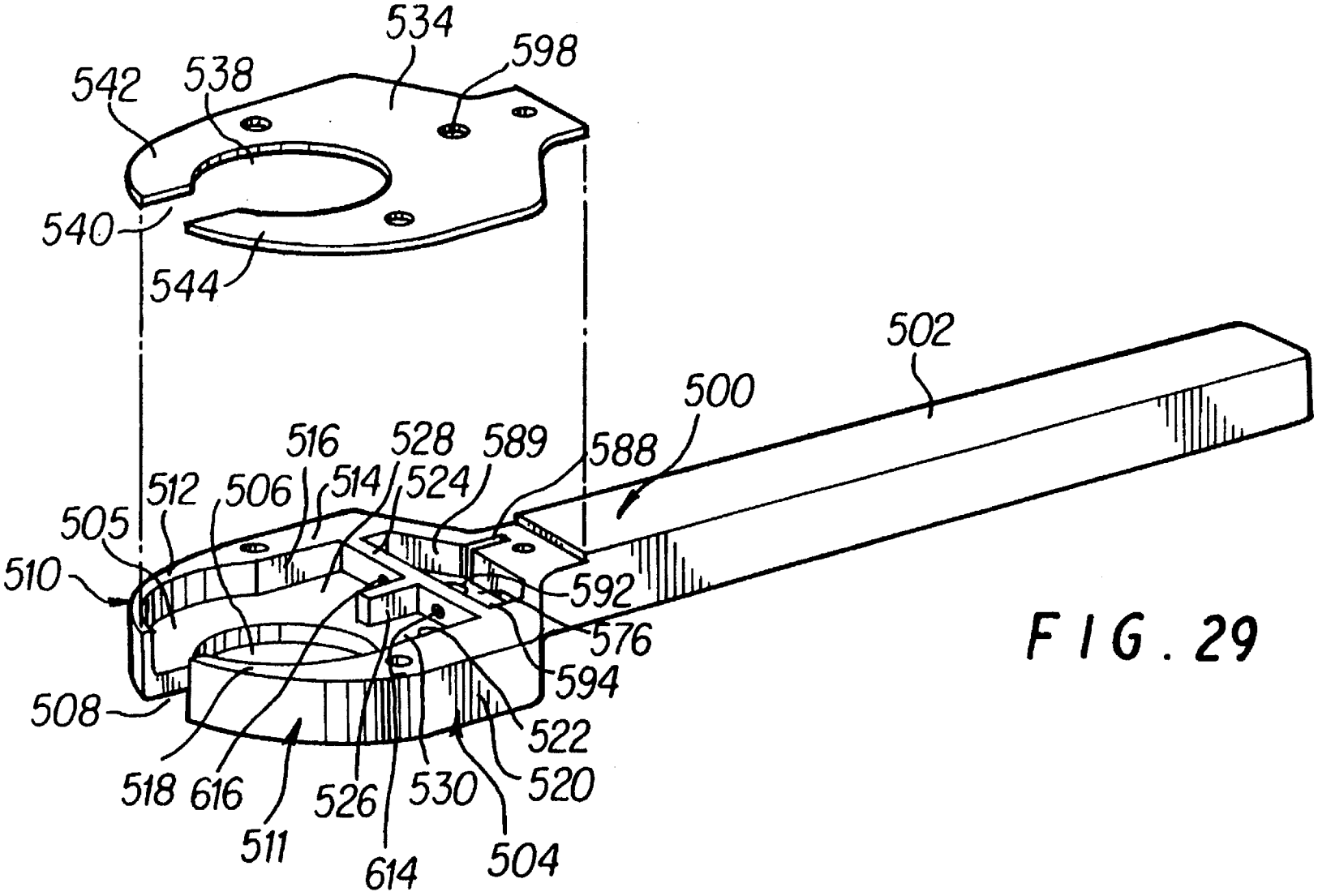
FIG. 29 is an exploded view of the casing of a third embodiment of the invention.
Figure 31:
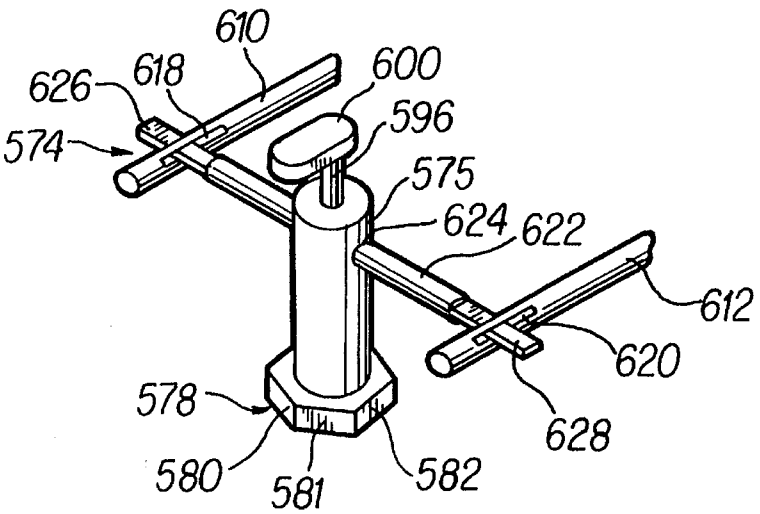
FIG. 31 is a perspective view of part of the control mechanism of the embodiment of FIG. 29.
Figure 30:
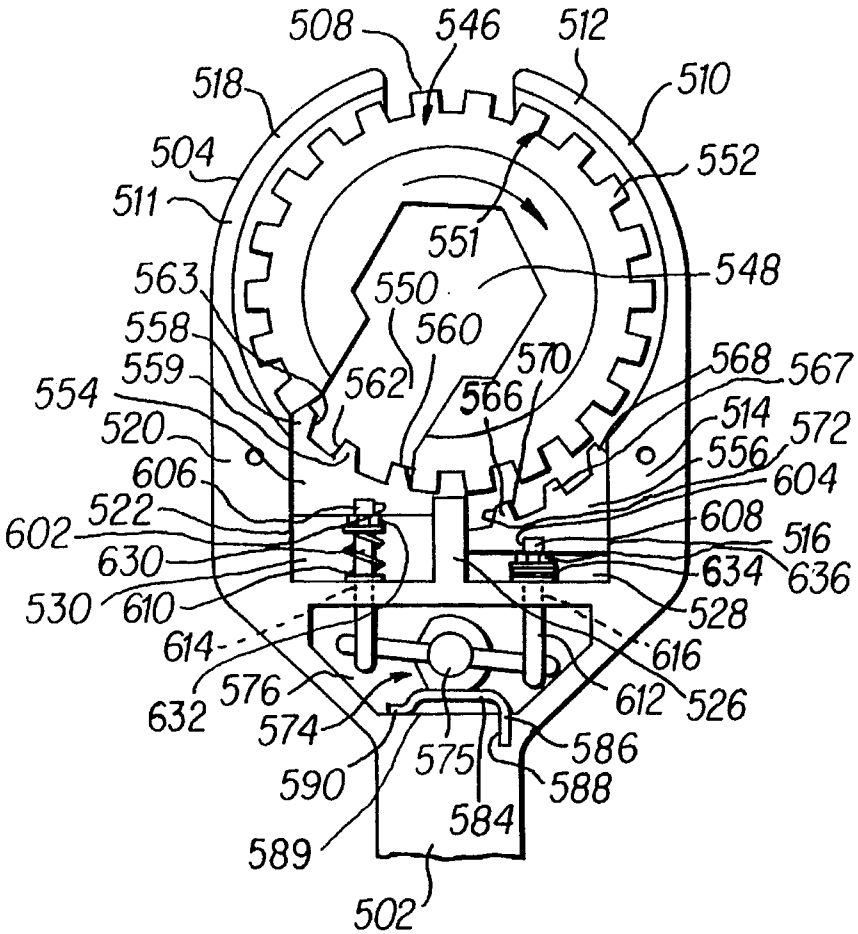
FIG. 30 is a partial view of the embodiment of FIG. 29 with the cover removed.

The third embodiment of the invention, shown in FIGS. 29–31, is also a compact wrench. As seen in FIG. 29, the wrench includes a bottom casing 500, having an elongated handle 502 and a head 504. Head 504 has a bottom wall 505 through which an opening 506 is formed. A slot 508 at the end of head 504 extends between the periphery of the head and opening 506. A peripheral wall 510 extends upwardly from bottom wall 505 and extends from the left side of slot 508 (as seen in FIG. 29) to handle 502. A second peripheral wall 511 extends upwardly from bottom wall 505 and extends from the right side of slot 508 (again as seen in FIG. 29) to handle 502. Wall 510 has an arcuate portion 512 and a portion 514 providing a straight inner wall 516 parallel to the longitudinal axis of the tool. Likewise, wall 511 has an arcuate portion 518 and a portion 520 providing a straight inner wall 522 also parallel to the longitudinal axis.

A crossbeam 524 extends between walls 516 and 522, and crossbeam 524 forms a T with a stem portion 526 which extends forwardly toward opening 506. The walls of stem portion 526 are parallel to walls 516 and 522 and form a pair of parallel guide channels 528 and 530 which extend parallel to the longitudinal axis of the tool.

A shoulder 532 on handle 502 forms space for a top casing member or cover 534 which fits over head 504. When placed on head 504, an end 536 of cover 534 abuts shoulder 532. An opening 538 is formed through cover 534, and an end slot 540 opens the end of cover 534. Slot 540 corresponds with slot 508, and opening 538 corresponds with opening 506. Slot 540 and opening 538 form a pair of arms 542 and 544 which fit over walls 510 and 511 and which conform with the shape of head 504. Bolt holes are provided in head 504 and through cover 534 to enable bolts to secure cover 534 to head 504.

Turning to FIG. 30, an operating jaw 546 has a nut-engaging opening 548 and a slot 550 extending from opening 548 to the periphery of jaw 546. A ratchet 551, with rectangular ratchet teeth 552 formed on the periphery of jaw 546, extends from one side of slot 550 to the other side thereof. It will be understood that jaw 546 of the third embodiment is substantially identical to jaw 110 of the embodiment of FIG. 1. Jaw 546 is journaled for rotation between bottom wall 505 and cover 534. Slots 508 and 540 are slightly wider than slot 550 of jaw 546. With slot 550 in alignment with slots 508 and 540, the tool is easily slipped endwise onto a bolt, or the like, for ready engagement with a nut thereon.

A pair of pawls 554 and 556 are positioned in guide channels 530 and 528, respectively, and, being slightly narrower than the guide channels, are adapted to slide rectilinearly in the guide channels from a position engaged with ratchet 551, to a position disengaged therefrom. Pawls 554 and 556 each have three pawl teeth with the same pitch as ratchet teeth 552. The teeth 558, 559 and 560 of pawl 554, as in the previous embodiments, have blocking sides 562, which extend generally radially of the jaw when engaged with a generally radial side of a ratchet tooth 552 facing in the counterclockwise direction, and sloping sides 563 facing in the counterclockwise direction of the jaw. Thus, pawl 554, when engaged with ratchet 551 blocks counterclockwise rotation and permits clockwise rotation of the jaw. Pawl 556 has pawl teeth 566, 567 and 568, which teeth have blocking sides 570 extending generally radially of the jaw when engaged with the generally radial side of a ratchet tooth 552 facing in the clockwise direction and sloping sides 572 facing in the clockwise direction of the jaw. When pawl 556 is engaged with ratchet 551, blocking side 570 blocks rotation in the clockwise direction, while sloping side 572 permits rotation in the counterclockwise direction. As seen in FIG. 30, the three pawl teeth of the pawls can control the direction of rotation of the pawl even when, as shown in the figure, a pawl is aligned with slot 550.

As shown in FIGS. 30 and 31, a single control means 574 controls the positions of pawls 554 and 556. It includes a control shaft 575 positioned in a control chamber 576 formed in bottom casing 500 behind crossbeam 524. Shaft 575 has a retention collar 578 at its lower end, the collar having three flats 580, 581, and 582 which cooperate with a flat spring 584 to hold the control position of the shaft. Flat spring 584 has a bent end 586 received in a slot 588 formed in the rear wall 589 of chamber 576 and a foot 590 at its opposite end bearing against rear wall 589. Control shaft 575 has a coaxial peg (not seen), extending from its bottom end and journaled in a hole 592 through the bottom wall 594 of chamber 576, and a coaxial shaft 596 extending upwardly from the top end of shaft 575 through an opening 598 in cover 534. A control handle 600 is mounted on shaft 596 and enables the user to control the tool.

Pawl 554 has a threaded bore 602 on its bottom edge (as seen in FIG. 30) and pawl 556 has a threaded bore 604. These openings receive the threaded ends 606 and 608 of pull rods 610 and 612 extending through bores 614 and 616 through crossbeam 524 to control chamber 576. Rods 610 and 612 have slots 618 and 620 near the rear ends of the rods. A holding rod 622 extends through a transverse bore 624 through control shaft 575 and has flat ends 626 and 628, extending through slots 618 and 620, respectively. A coil spring 630 is positioned around pull rod 610 between crossbeam 524 and a nut 632 threaded on rod 610 and bearing against the rear surface of pawl 554. A second coil spring 634 is similarly positioned about pull rod 612 between crossbeam 524 and a nut 636 threaded on pull rod 612 and bearing against the rear side of pawl 556. Springs 630 and 634 assist in engaging pawls 554 and 556 with ratchet 551.

When control shaft 575 is rotated by handle 600 to bring flat 582 in engagement with spring 584, holding rod 622 engages the forward end of slot 618 to move pull rod 610 forward and slide pawl 554 into engagement with ratchet 551. Since pawl teeth 558, 559 and 560 have the same pitch as ratchet teeth 552, blocking sides 562 easily engage and abut face-to-face the counterclockwise facing sides of ratchet teeth 552 blocking counterclockwise rotation of jaw 546. The span of pawl 554 is great enough so that in the case illustrated in FIG. 30, where pawl 554 engages jaw 546 at the position of slot 550, blocking side 562 of pawl tooth 558 is in position to engage and abut the ratchet tooth 552 adjacent slot 550 and block counterclockwise rotation of jaw 546. For rotation of jaw in the clockwise direction, sloping sides 563 are able to slide over ratchet teeth 552 due to compression of spring 630, and clockwise rotation is therefore permitted. It will be noted that when pawl 554 is engaged with ratchet 551 by rod 610, flat end 628 of rod 622 engages the rear end of slot 620 to pull rod 612 rearwardly to slide pawl 556 to the position shown in FIG. 30 disengaged from jaw 546.

When shaft 575 is rotated to bring flat 580 against spring 584, the situation is reversed: pawl 556 is engaged with ratchet 551 and pawl 554 is disengaged therefrom. Blocking sides 570 of pawl teeth 566, 567 and 568, which have the same pitch as ratchet teeth 552, engage and abut the clockwise facing sides of ratchet teeth 552 blocking clockwise rotation of jaw 546. On the other hand, sloping sides 572 of the pawl teeth will be able to slip over ratchet teeth 552 due to give in springs 634, permitting rotation in the counterclockwise direction.

When shaft 575 is rotated to bring flat 581 against spring 584, both pawls 554 and 556 are pulled clear of ratchet 551, permitting free rotation in both directions.

The blocking sides 562 of pawl teeth 558, 559 and 560 of pawl 554 and the blocking sides 570 of pawl teeth 566, 567 and 568 of pawl 556, when engaged with a counterclockwise facing or a clockwise facing side of a ratchet tooth 552, abut the respective side face to face—that is, the blocking side lies in a plane which is parallel to the radial center line and side of the rectangular ratchet teeth 552. As explained above, as used in this specification and claims, the terms "generally radial" or "generally radially" are considered as encompassing blocking sides which are so situated.

Since the embodiment of FIGS. 29–31 does not use pivoted pawls, there is no problem with the pawl teeth binding when the pawl teeth engage or release from ratchet 551.

The tool of this embodiment is compact, the width of the tool being determined by the width of jaw 546, the thickness of walls 510 and 511, and the clearance between these walls and jaw 546. Less space transversely of the tool is required for pawls 554 and 556, parallel guide paths 528 and 530 and control means 574 than is required by jaw 546—that is, pawls 554 and 556, guide paths 528 and 530 and control means 574 are all closer to the longitudinal axis of the tool than the lateral extremities of jaw 546.

The tool may also be very thin. To this end, pawls 554 and 556 and jaw 546 are as thin as possible and are substantially in the same plane. By using a thin housing cover 534, and pawls which are only 0.15 inch thick, an example of the wrench is only 0.432 inch thick. Only control handle 600 and shaft 596 extend beyond the casing.

Although the invention has been described with reference to particular embodiments, it is to be appreciated that various adaptations and modifications may be made within the spirit of the invention.

The invention claimed is:

1. An open end reversible wrench, comprising:

a head having an aperture;

an operating jaw journaled for rotation in said aperture, said jaw having a nut-engaging opening, a slot extending from said nut- engaging opening to the peripheral surface of said jaw, and a ratchet having ratchet teeth formed in said peripheral surface from one side of said slot to the other side thereof;

a pair of reciprocating ratchet pawls, one for allowing rotation of said jaw in a clockwise direction and for blocking rotation in a counterclockwise direction and the other for allowing rotation of said jaw in a counterclockwise direction and for blocking rotation in the clockwise direction, said ratchet pawls each having a plurality of projecting pawl teeth;

a pair of guide means, one for guiding said one ratchet pawl along a first rectilinear path parallel to and on one side of the longitudinal axis of said wrench and the other for guiding said other ratchet pawl along a second rectilinear path parallel to and on the other side of said longitudinal axis of said wrench; and single control means for selectively engaging said one of said pawls with said ratchet for rotation of said jaw in said clockwise direction or said other of said pawls with said ratchet for rotation of said jaw in said counterclockwise direction, no more than a single pawl being engaged with said ratchet at any one time, said single control means comprising a control shaft, a handle for rotating said control shaft, and linkage means coupling said control shaft to said pawls, said control shaft having a first position causing said linkage means to position said one pawl in engagement with said ratchet and said other pawl out of engagement with said ratchet, a second position causing said linkage means to position said one pawl out of engagement with said ratchet and said other pawl in engagement with said ratchet, and a third position causing said linkage means to position both pawls out of engagement with said ratchet.

2. A wrench according to claim 1, wherein a retention collar is positioned on said control shaft, said collar having three flat surfaces corresponding to said first, second and third position of said control shaft, and wherein a retention flat spring bears against said retention collar to retain it in one of said positions.

3. A wrench according to claim 1, wherein said linkage means includes bias springs for biasing said pawls towards engagement with said ratchet.

4. A wrench as recited in claim 1, wherein said linkage means comprises a holding rod extending through a bore provided transversely through said control shaft, said holding rod having flattened ends, a first pull rod having a forward end fastened to said one pawl and a rear end having a slot extending through said first pull rod, and a second pull rod having a forward end fastened to said other pawl and a rear end having a slot extending through said second pull rod, said flattened ends of said holding rod extending through said slots of respective pull rods.

5. A wrench according to claim 4, wherein a crossbeam separates said guide means from a chamber in which control shaft is located, said pull rods extending through bores through said crossbeam, and wherein a first biasing coil spring is positioned about said first pull rod between said crossbeam and said one pawl and a second biasing coil spring is positioned about said second pull rod between said crossbeam and said other pawl.

* * * * *